United States Patent [19]

Jennings, Jr.

[11] Patent Number: 4,982,786

[45] Date of Patent: Jan. 8, 1991

[54] USE OF $CO_2$/STEAM TO ENHANCE FLOODS IN HORIZONTAL WELLBORES

[75] Inventor: Alfred R. Jennings, Jr., Plano, Tex.

[73] Assignee: Mobil Oil Corporation, Fairfax, Va.

[21] Appl. No.: 379,759

[22] Filed: Jul. 14, 1989

[51] Int. Cl.[5] ..... E03B 3/11

[52] U.S. Cl. ..... 166/50; 166/272; 166/303; 166/309

[58] Field of Search ..... 166/50, 272

[56] References Cited

U.S. PATENT DOCUMENTS

| | | | |
|---|---|---|---|
| 4,257,650 | 3/1981 | Allen | 166/50 |
| 4,410,216 | 10/1983 | Allen | 166/50 |
| 4,607,699 | 8/1986 | Stephens | 166/303 |
| 4,736,792 | 4/1988 | Brown et al. | 166/252 |
| 4,756,369 | 7/1988 | Jennings et al. | 166/272 |

*Primary Examiner*—Ramon S. Britts
*Assistant Examiner*—Roger J. Schoeppel
*Attorney, Agent, or Firm*—Alexander J. McKillop; Charles J. Speciale; Charles A. Malone

[57] ABSTRACT

A method to enhance steam flooding where at least two horizontal wellbores are utilized. Carbon dioxide is injected into a lower perforated horizontal wellbore. Once sufficient carbon dioxide has been injected into the formation, steam is injected through the lower horizontal wellbore. The steam displaces the carbon dioxide into the formation where it contacts and mixes with hydrocarbonaceous fluids. Steam causes the carbon dioxide to expand, thereby providing for a better sweep of the formation. Steam injection is ceased and liquid carbon dioxide injection again is commenced. Afterwards, steam is injected again into the formation. This sequence is continued until it becomes uneconomical to produce hydrocarbonaceous fluids from an upper horizontal wellbore. Hydrocarbon displacement efficiencies are enhanced when hydrocarbons are produced into the upper horizontal wellbore due to viscosity and density differences.

5 Claims, 1 Drawing Sheet

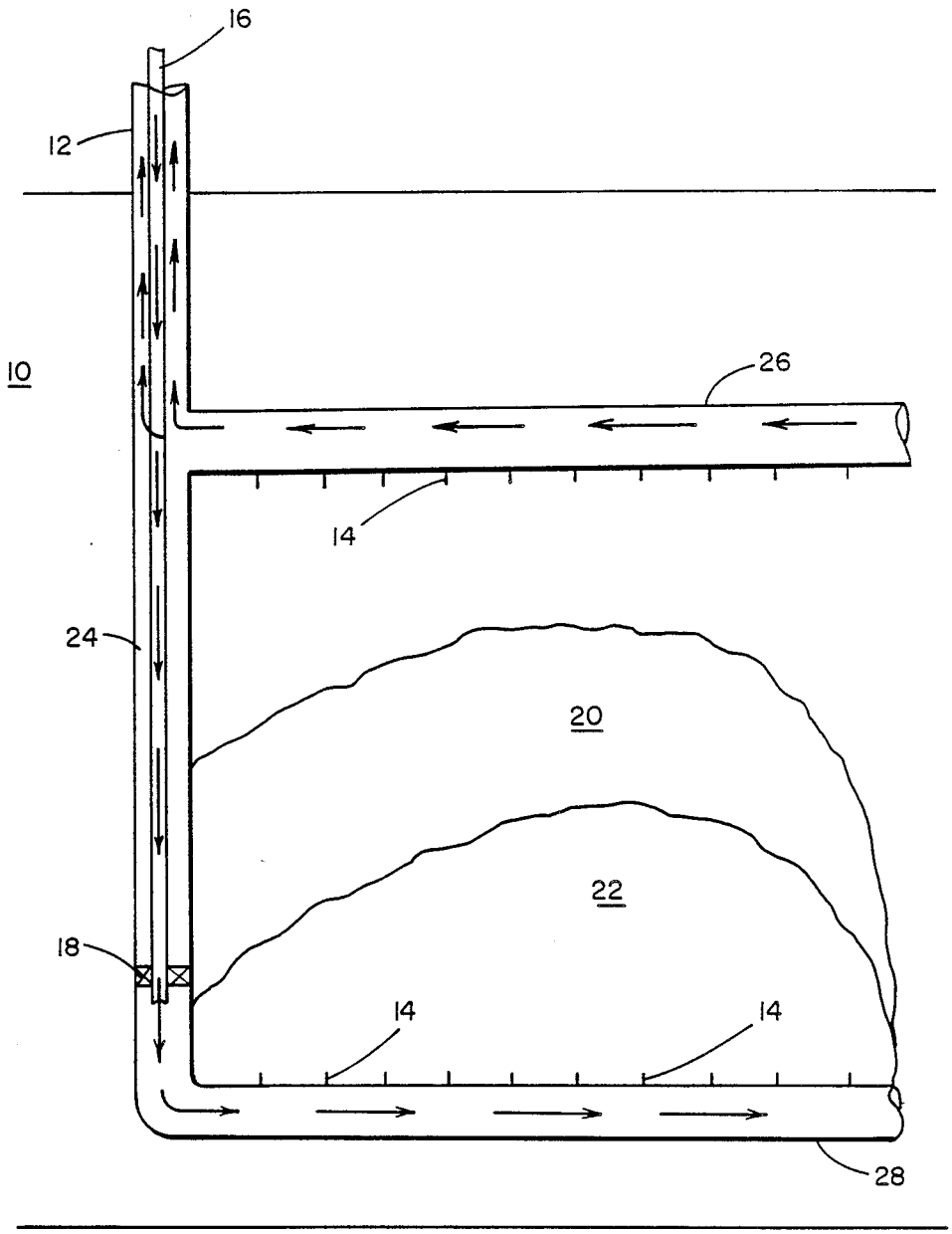
16
12
10
26
14
24
20
22
18
14
14
28

USE OF $CO_2$/STEAM TO ENHANCE FLOODS IN HORIZONTAL WELLBORES

FIELD OF THE INVENTION

This invention is directed to a method for carbon dixoide/steam stimulation of hydrocarbonaceous fluids via at least two horizontal wellbores. More particularly, it is directed to the use of liquid carbon dioxide and a subsequent steam flood which causes the expansion of carbon dioxide so as to obtain a substantially better sweep of a formation containing said horizontal wellbores.

BACKGROUND OF THE INVENTION

With advances in drilling technology, it is currently possible to drill horizontal wellbores deep into hydrocarbon producing reservoirs. Utilization of horizontal wellbores allows extended contact with a producing formation, thereby facilitating drainage and production of the reservoir.

Although horizontal wellbores allow more contact with the producing formation, some difficulties are encountered when horizontal wellbores are utilized which are not commonly experienced when vertical wells are used. Methods used in producing hydrocarbons from a formation or reservoir via vertical wells often prove to be inefficient when attempting to remove hydrocarbons from a reservoir where horizontal wellbores are being used. This inefficiency results in utilization of increased amounts of fluids used during enhanced oil recovery operation. This results in a dimunition in the amount of hydrocarbons removed from the formation or reservoir.

This inefficiency is demonstrated when a carbon dixoide flood is utilized with a vertical wellbore where the formation contains zones of varying permeability. Often the carbon dioxide overrides a zone of lower permeability leaving hydrocarbonaceous fluids behind.

U.S. Pat. No. 4,736,792, issued to Brown et al. on Apr. 12, 1988, discloses a method for treating a well completed in a subterranean formation containing petroleum where a preconditioning process was employed. The preconditioning process was used to improve the receptivity of the formation to steam. The method involved injecting a heated non-condensible and oil soluble gas, in the gaseous phase, into the formation so as to avoid permanently fracturing the formation and also avoid the immediate formation of an oil bank.

Stephens in U.S. Pat. No. 4,607,699, issued Aug. 26, 1986, discusses a huff-puff cyclic steam stimulation method. Here a formation is fractured by liquid carbon dioxide injection. While carbon dioxide is still in place within the formation, steam is injected into the formation. After a suitable soaking period, the well is opened to production.

Therefore, what is needed is a method to improve the sweep efficiency of liquid carbon dioxide in a formation where only horizontal wellbores are utilized and the formation is not fractured.

SUMMARY OF THE INVENTION

This invention is directed to a method for the removal of hydrocarbonaceous fluids from a formation which is penetrated by at least two horizontal wellbores. In the practice of this invention, liquid carbon dioxide is injected into a lower horizontal wellbore where it enters the formation and contacts hydrocarbonaceous fluids therein. While the liquid carbon dioxide is in the formation, steam is injected into the lower horizontal wellbore so as to cause the liquid carbon dioxide to be heated and expand. Heating also causes the carbon dioxide to go into its gaseous state and make additional contact with hydrocarbonaceous fluids in the formation. Any carbon dioxide that remains undissolved in the formation is driven deeper into the formation by the steam where it makes additional contact with the hydrocarbonaceous fluid-containing formation. Pressure exerted by the steam and the carbon dioxide causes a hydrocarbonaceous/carbon dioxide fluid mixture to form which proceeds upwardly through the formation into an upper horizontal wellbore. The mixture of hydrocarbonaceous fluids, gaseous carbon dioxide, steam, and water exits the formation through the upper horizontal wellbore where it is produced to the surface. Upon reaching the surface, the hydrocarbonaceous fluids are separated from the carbon dioxide, steam and water.

It is therefore an object of this invention to increase the vertical relative permeability of a formation in which at least two horizontal wellbores have been placed for the removal of hydrocarbonaceous fluids.

It is another object of this invention to use liquid carbon dioxide and a steam flood in a formation containing at least two horizontal wellbores so as to maximize drainage of the formation.

It is yet another object of this invention to provide for liquid carbon dioxide stimulation of the formation in combination with steam so that the formation can be stimulated with any length of a horizontal wellbore.

It is a still further object of this invention to provide for a liquid carbon dioxide/steam flood method which can enhance oil recovery from a formation via at least two horizontal wellbores.

BRIEF DESCRIPTION OF THE DRAWING

The drawing is a schematic representation showing displacement of formation oil by expanded carbon dioxide where two horizontal wellbores are utilized.

DESCRIPTION OF THE PREFERRED EMBODIMENTS

In the practice of this invention as is shown in the drawing, wellbore 12 penetrates a hydrocarbonaceous fluid-bearing formation 10. Hydrocarbonaceous fluids in said formation can have a gravity of from about 10 to about 60 API degrees. At its lower end wellbore 10 is deviated in a manner so as to form a lower horizontal wellbore 28 which contains perforations 14 on its topside. At a desired distance from horizontal wellbore 28 is placed an upper horizontal wellbore 26 which has perforations 14 on its bottomside. Horizontal wellbore 26 is fluidly connected to wellbore 12. The angle of deviation from vertical wellbore 12 for both horizontal wellbore 26 and horizontal wellbore 28 is about 10° to about 90°. Tubing 16 is centered in the vertical portion of wellbore 12 by packer 18 so as to cause fluid communication by tubing 16 with only lower horizontal wellbore 28. Tubing 16 being centered in wellbore 12 and held in place by packer 18 forms annulus 24 in wellbore 12 which annulus fluidly communicates with upper horizontal wellbore 26 only.

In order to remove hydrocarbonaceous fluids from formation 10, liquid carbon dioxide is injected into tubing 16 where it flows into formation 10 via perforations 14 contained in lower horizontal wellbore 28. Once in formation 10, the temperature of formation 10 causes some of the liquid carbon dioxide to form a gas which penetrates the formation and mixes with hydrocarbonaceous fluids contained therein. A portion of the liquid carbon dioxide dissolves in the oil lowering the oil's viscosity and causing the formation contacted to be more receptive to steam penetration. Any undissolved liquid carbon dioxide that remains in the formation is driven deeper into formation 10 by a subsequent steam flood. Liquid carbon dioxide is injected into the formation at a rate and volume which will not fracture the formation. Once sufficient liquid carbon dioxide has been injected into formation 10, injection of liquid carbon dioxide into formation 10 is ceased. A method for injecting liquid carbon dioxide into formation 10 is disclosed in U.S. Pat. No. 4,607,699, issued to Stephens on Aug. 26, 1986. This patent is hereby incorporated by reference. The teachings of this patent can be utilized so long as the fracturing pressure of formation 10 is not exceeded by liquid carbon dioxide injection.

After all the liquid carbon dioxide has been injected, steam injection is commenced. A method for injecting steam into the formation is discussed in U.S. Pat. No. 4,607,699, as mentioned above. Steam is injected via tubing 16 into lower horizontal wellbore 28 by perforations 14 where it enters formation 10. Steam injection is continued until a sufficient amount of steam has been directed into the formation. When the steam contacts the liquid carbon dioxide 20, it converts the liquid carbon dioxide into its gaseous state whereupon it mixes with hydrocarbonaceous fluids in formation 10 and is pushed outwards toward upper wellbore 26. When the mixture comes into contact with wellbore 26, it enters perforations 14 and exits wellbore 26 via annulus 24 and is removed from the formation by wellbore 12 to the surface. After removing the carbon dioxide/hydrocarbonaceous fluid mixture from the formation, it is separated from the carbon dioxide, steam and water.

Displacement efficiencies in directing hydrocarbonaceous fluids to the upper horizontal wellbore 26 are enhanced by injecting liquid carbon dioxide again into the formation. Once sufficient liquid carbon dioxide has been injected into the formation, injection of carbon dioxide is ceased and steam injection once again commenced. This sequence is repeated until the desired amount of hydrocarbonaceous fluids has been removed from the formation.

As will be understood by those skilled in the art, although an upper and lower wellbore are shown in the drawing communicating fluidly with the vertical section of wellbore 12, individual horizontal wellbores can be utilized. A separate lower horizontal wellbore can be used as an injector well, while an upper separated horizontal wellbore can be used as a producer well. Multiple lower and upper horizontal wellbores can be utilized.

Obviously, many other variations and modifications of this invention as previously set forth may be made without departing from the spirit and scope of this invention, as those skilled in the art readily understand. Such variations and modifications are considered part of this invention and within the purview and scope of the appended claims.

What is claimed is:

1. A method for recovering hydrocarbonaceous fluids from a formation penetrated by at least two horizontal wells comprising:

(a) injecting liquid carbon dioxide through at least one lower horizontal well into said formation at a pressure insufficient to fracture said formation;

(b) thereafter injecting steam into said lower horizontal well, thereby causing said liquid carbon dioxide to convert to its gaseous state and expand thereby making a substantially better sweep of the formation;

(c) recovering hydrocarbonaceous fluids, gaseous carbon dioxide, steam and water from said formation via at least one upper horizontal well; and (d) repeating steps (a), (b) and (c).

2. The method as recited in claim 1 where fluids recovered from step (c) are separated.

3. The method as recited in claim 1 where the API gravity of hydrocarbonaceous fluids in said formation prior to carbon dioxide injection is from about 10 to about 60 API degrees.

4. A method for recovering hydrocarbonaceous fluids from a formation penetrated by at least two horizontal wells comprising:

(a) injecting liquid carbon dioxide through at least one lower horizontal well into said formation at a pressure insufficient to fracture said formation;

(b) thereafter injecting steam into said lower horizontal well, thereby causing said liquid carbon dioxide to convert to its gaseous state and expand thereby making a substantially better sweep of the formation;

(c) repeating steps (a) and (b);

(d) recovering hydrocarbonaceous fluids, gaseous carbon dioxide, steam and water from said formation via at least one upper horizontal well; and (e) separating the fluids recovered from step d.

5. The method as recited in claim 4 where the API gravity of hydrocarbonaceous fluids in said formation prior to carbon dioxide injection is from about 10 to about 60 API degrees.

* * * * *